US006900798B2

(12) United States Patent
Heie

(10) Patent No.: US 6,900,798 B2
(45) Date of Patent: May 31, 2005

(54) POWER-CONSERVATION FEATURE FOR LIQUID CRYSTAL DISPLAY

(75) Inventor: Anders Fahnoe Heie, Poway, CA (US)

(73) Assignee: Nokia Corporation, Espoo (FI)

( * ) Notice: Subject to any disclaimer, the term of this patent is extended or adjusted under 35 U.S.C. 154(b) by 163 days.

(21) Appl. No.: 09/943,848

(22) Filed: Aug. 31, 2001

(65) Prior Publication Data

US 2003/0043096 A1 Mar. 6, 2003

(51) Int. Cl.[7] ..... G09G 5/00
(52) U.S. Cl. ..... 345/211
(58) Field of Search ..... 345/204, 211, 345/212, 213, 214, 694, 696, 698, 87, 90, 98, 99, 100; 455/574, 343.2, 343.5, 419, 421

(56) References Cited

U.S. PATENT DOCUMENTS 5,598,565 A * 1/1997 Reinhardt ..... 345/212
5,867,140 A * 2/1999 Rader ..... 345/211
6,256,476 B1 * 7/2001 Beamish et al. ..... 455/574
6,408,172 B1 * 6/2002 Alperovich et al. ..... 455/574
6,501,949 B1 * 12/2002 Singleton ..... 455/343.3

* cited by examiner

*Primary Examiner*—Chanh Nguyen

(57) ABSTRACT

An improved liquid crystal display (LCD) system that includes a user-selectable method for reducing the amount of electrical power consumed by the LCD. When a power-conservation mode is selected, power-conservation circuitry acts upon the pixel activation sequence as normally determined by the LCD driver. To minimize power consumption, a subset of the pixels otherwise to be activated are sent no power. The subset of no-power pixels may be a fixed percentage, such as fifty percent, or may vary according to the image being displayed. In either case, the pixel elements of the no-power subset may be alternated so as to minimize the impact of the power-conservation feature on the displayed image.

15 Claims, 5 Drawing Sheets

POWER-CONSERVATION FEATURE FOR LIQUID CRYSTAL DISPLAY

The present invention generally relates to visual displays for electronic devices; and relates more specifically to a power-efficient liquid-crystal display (LCD) system and method of operating the same.

BACKGROUND OF THE INVENTION

Various types of visual displays are used in connection with electronic devices. A television, for example, uses a cathode-ray tube (CRT), where a directed beam of electrons selectively excites phosphors in the screen, producing a multitude of variously-colored picture elements (pixels), that collectively form an image. Light-emitting diodes (LEDs) are also common, though far more limited in their ability to display complex images. Although somewhat more difficult to manufacture, liquid-crystal displays (LCDs) are gaining popularity because of their image-producing versatility and low-power consumption.

In general, LCDs are composed of a liquid-crystal layer sandwiched between transparent light-polarizing materials, along with electrical conductors and electrodes that enable a bias voltage to be applied across a specific small area (that is, a pixel) of the liquid-crystal layer. Applying the voltage difference to the pixel electrode alters the light-polarizing characteristics of the liquid crystal material proximate to the electrode. Light waves that are polarized when passing through one polarizing layer will typically not pass through the other, cross-polarized layer, unless the phase angle of the polarized light is changed as it passes through the liquid-crystal layer between them. Liquid crystals are substances that flow like liquids, but whose molecules nevertheless maintain a definite orientation with respect to each other. This orientation may be changed from one that causes the needed phase-angle change to one that does not, through the application of an electrical charge, as described above. The liquid-crystal orientation, therefore, determines whether the pixel will appear light or dark.

In an LCD, the light that produces the image itself is not created by the liquid crystals, but is supplied by separate light-sources such as LEDs or reflected ambient light. LCDs create images by determining where light will be allowed to pass through the LCD assembly and where it will be absorbed. In this sense, it is more appropriate to say that a portion of the liquid-crystal material is "activated" by the applied voltage, rather than illuminated. The amount of this light that is allowed through can be controlled very specifically by adjusting the level of the applied voltage. This means that the pixel can be adjusted to one of many finely varying levels of brightness. Color LCDs operate by employing three independently-controllable sub-pixels for each display pixel. Depending on the individually applied voltage, the sub-pixels filter out varying amounts of red, green, and blue light, respectively, to produce the different-colored portions of a displayed image. The color of each image pixel is determined by the intensity of light permitted to pass through its colored sub-pixels.

The liquid-crystal activating voltage potential can be supplied to the pixel in different ways. The simplest uses a transparent, conductive backplate (or plane). Smaller appropriately-shaped electrodes on the transparent front plate form the opposite charge plates that can be selectively turned on and off. This arrangement is satisfactory for calculator displays and the like where only a limited number of shapes and letters such as numerals or letters will need to be formed by combining the individual elements, such as numerals or letters.

More advanced LCDs use a grid of conductor rows and columns to activate selected pixels or sub-pixels. More than one pixel may be simultaneously activated by this row and column matrix, although a complete image cannot usually be created in this way. Multiplexing may be used, however, to create the proper combination of light and dark pixels. In this case, a pre-determined number of pixels are activated in each of a number of sequential steps. The speed at which alternating pixel groups are activated should be sufficient to produce an image detectable by the human eye. In addition, a capacitor may be associated with each pixel, allowing it to retain some charge even when it is not actively connected to the voltage source.

LCDs can now be found on many electronic devices. For example, modern video camera-recorders (camcorders) often include an integrated LCD video display. Many camcorders include an optical or electronic viewfinder as well, although many users prefer to watch the LCD while they are recording because it provides the most representative image of what is being captured.

Camcorders, being portable, are usually battery-powered (although they may be able to use other power sources when available). The batteries are of a type, for example nickel-cadmium, that can be repeatedly recharged. An actual "change" of batteries is, therefore, not regularly required under normal operating conditions. The amount of time that a user can operate the camcorder between battery recharges is of some importance, however. Since the camcorder is portable it is often carried to locations remote from alternate power sources. Once the batteries are discharged, the camera is inoperable until they can be recharged. One or more extra charged batteries can be carried, of course, but doing so imposes somewhat of an inconvenience. And, of course, any extra batteries will eventually discharge below operating power levels as well.

In the future, (and even to some extent in the present) complex LCDs will also be found on mobile telephones and personal digital assistants (PDAs). Such devices are and will continue to be used to provide wireless access to public and private communications networks such as the Internet. Through one of these devices, a user can connect to the network and download various text and graphic files from, for example, Web servers. The files' content can then be viewed on the LCD. These portable wireless devices create even more severe power-consumption restrictions because of their small size. No mobile phone the size of a camcorder would today be commercially accepted, and so ever-smaller batteries are being required to function for an ever-increasing time between charges.

It is, therefore, advantageous to design as many power-conservation features as possible into battery-powered devices, such as mobile phones, PDAs, and camcorders. Several such features already exist. Perhaps the most simple is an on/off switch, which allows the user to select a mode that consumes no power (or almost none). The device also may automatically shut itself off, or, alternately, turn off only selected power-consuming operations, after a certain pre-determined period of non-use.

The LCD display, in spite of its power-consumption advantage, still consumes a significant amount of power. One way to conserve display power, of course, is by shutting down the display itself when it is not in use—even if other (non-display) operations are continuing. This may even be done automatically, for example by turning on the display only when a motion detector detects the user's presence, or turning it off when a low-power state is detected. Other power-saving approaches make use of ambient light when available to back light the LCD and produce a brighter image without consuming extra battery power.

What is needed, however, is a power-conservation feature that can be selectively used to reduce LCD power consumption in battery-powered devices such as mobile phones and camcorders, regardless of available ambient light, and yet allow the user to continue utilizing the display for its intended function. The present invention provides just such a solution.

SUMMARY OF THE INVENTION

In one aspect, the present invention is a liquid crystal display (LCD) system that includes a display having a plurality of pixels, pixel-control circuitry for controlling the illumination of each of the pixels to form an image, and a power-supply for routing power from a power source such as a battery to the LCD driver circuitry, and eventually to the pixels themselves. The LCD driver circuitry enables an LCD display power-conservation mode in which a selected subset of the LCD-display pixels are not energized. The pixel-control circuitry may also determine, according to predetermined criteria, which pixels to turn off based on the image being displayed and thereby affect the image-quality as little as possible.

In another aspect, the present invention is a method for conserving power in an LCD system that includes the steps of determining when power-conservation mode has been selected, or alternately entering power conservation mode automatically based on predetermined criteria, and then selectively reducing activation power to a subset of the pixels making up the LCD display. The method may further include the step of changing the subset of omitted pixels. This may include shutting down power to fifty percent of the pixels, then switching to the other fifty percent. This change may be done abruptly or by reactivating only a selected portion of the powered-down pixels and shutting down only a corresponding portion of these previously illuminated.

DETAILED DESCRIPTION

Figure 1A:
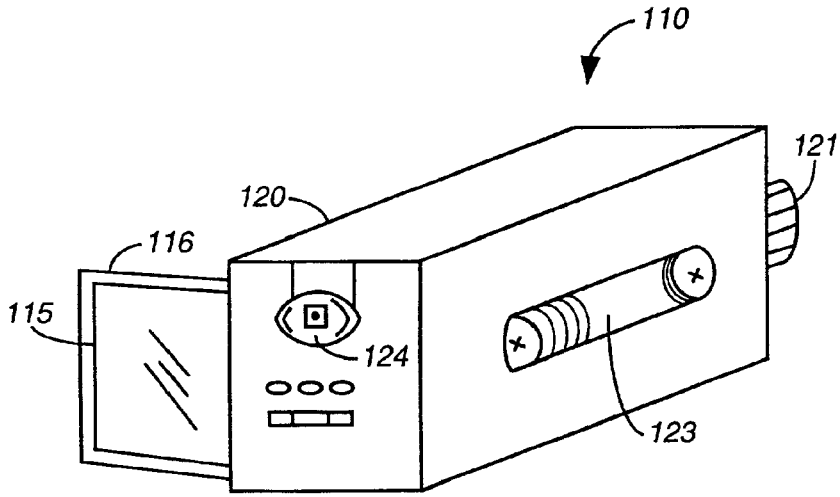
FIGS. 1A–1C illustrate three exemplary battery-powered electronic devices having liquid crystal displays (LCDs), the three devices being a video camera-recorder (camcorder), a wireless mobile phone, and a personal digital assistant (PDA), respectively, which devices may be advantageously used in accordance with an embodiment of the present invention.
Figure 1B:
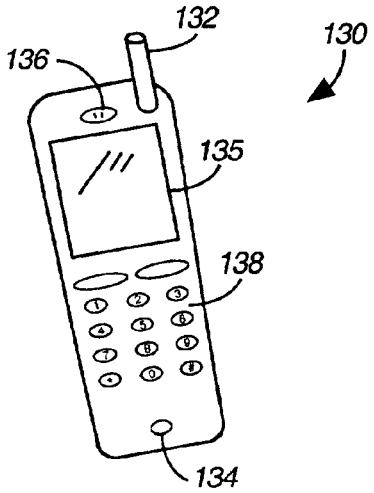
Figure 1C:
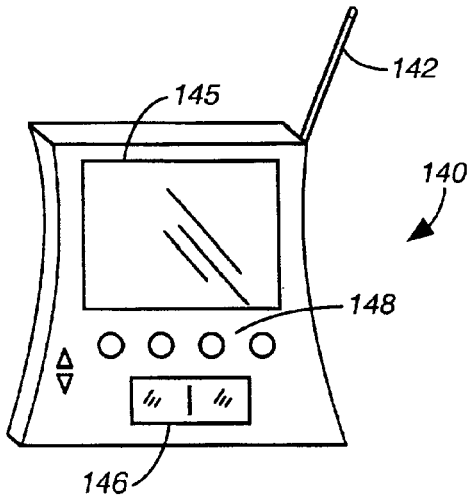

FIGS. 1A–1C illustrate three exemplary battery-powered electronic devices having LCD displays, the three devices being a video camera-recorder (camcorder) 110, a wireless mobile phone 130, and a personal digital assistant (PDA) 140, respectively, which devices may be used in accordance with an embodiment of the present invention. FIG. 1A is a video camera-recorder (camcorder) 110 having an LCD 115 attached to the camcorder housing 120. Typically, the LCD 115 will be housed in an LCD frame 116 that includes a hinge (not shown) so that is can be rotated into a desirable orientation for use and folded back against camcorder housing 120 when not in use. When in position for viewing, LCD 115 faces rearward with respect to lens 121 so that the user may view the display while making a recording, in which case it displays a representation of the same video data being sent to the videotape 123 for storage. It generally may also be used to playback a previously recorded video sequence. Before the introduction of LCDs for camcorder use, many systems featured a 'viewfinder', such as viewfinder 124 shown in FIG. 1A. The purpose of the viewfinder 124 is to assist the user in properly directing the camera by displaying a representation of the image being recorded. Note that this aiming function can adequately be accomplished by a target window, for example, an optical one that allows the user to view the subject either directly or as redirected through an arrangement of lenses and mirrors. More recently, however, electronic viewfinders have become more popular. This electronic viewfinder is often a small cathode-ray tube (CRT) that displays a representation of the captured image. The CRT may be capable of a playback function as well. As shown in FIG. 1A, both the viewfinder 124 and the LCD 115 may be present on the same camcorder. In this case the user may chose the viewing device that is most convenient for use at a particular time.

FIG. 1B is an exemplary mobile telephone 130. Mobile phones have for some time made use of LCD technology, though often only for simple displays that show letters and numerals (see, for example, FIG. 2A). Mobile telephone 130 is capable of communicating with a communications network (not shown), generally through a wireless link to a nearby base station. As it moves from one place to another during an ongoing conversation, it may be 'handed-off' from one base station to the next so that conversation may continue without having to reestablish a communication channel. Mobile phone 130 features antenna 132 for use in transmitting and receiving communications data from the communications network, microphone 134 and speaker 136 for voice communication, and keypad 138 through which non-voice input, such as a telephone number, may be entered. Mobile telephone 130 features an enlarged LCD 135 for displaying phone numbers and multiple lines of text and, when available, graphical images as well. Many such phones are now capable of receiving graphic data available through the Internet, such as the content associated with a World Wide Web site. (Such communications may be routed through a gateway (not shown) functionally positioned between the base station and an Internet node.) Graphics images such as those available from a Web site may require an advanced display such as LCD 135 for viewing on a mobile telephone.

Another, similar device for Web access is a wireless personal digital assistant (PDA) such as PDA 140 shown in FIG. 1C. Descended from small portable computers with only enough memory and processing power to function as an electronic address book and calendar, many of these devices now incorporate a large number of applications, even including wireless communication. In any form, PDA 140 generally includes LCD 145 and touch-entry screen 146. If equipped for wireless communications, antenna 142 and keypad 148 may be present as well. PDA 140 may also permit attachment of a connector allowing wireline communication. In either instance, web pages are then accessible for display on LCD 145.

Figure 2A:
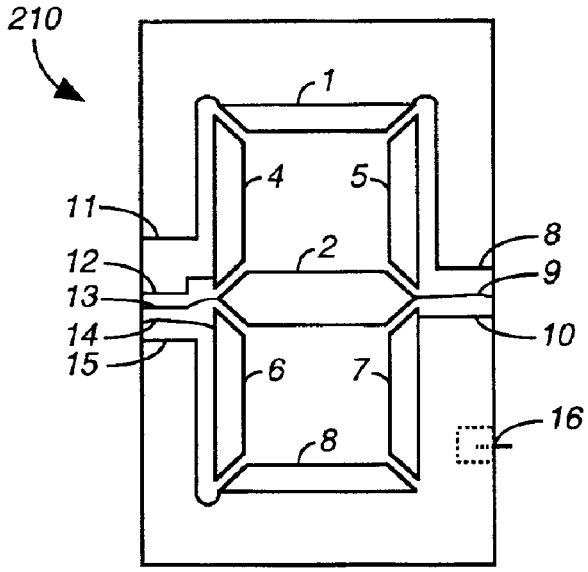
FIGS. 2A–2B illustrate two exemplary LCD portions, enlarged to show individual pixels.
Figure 2B:
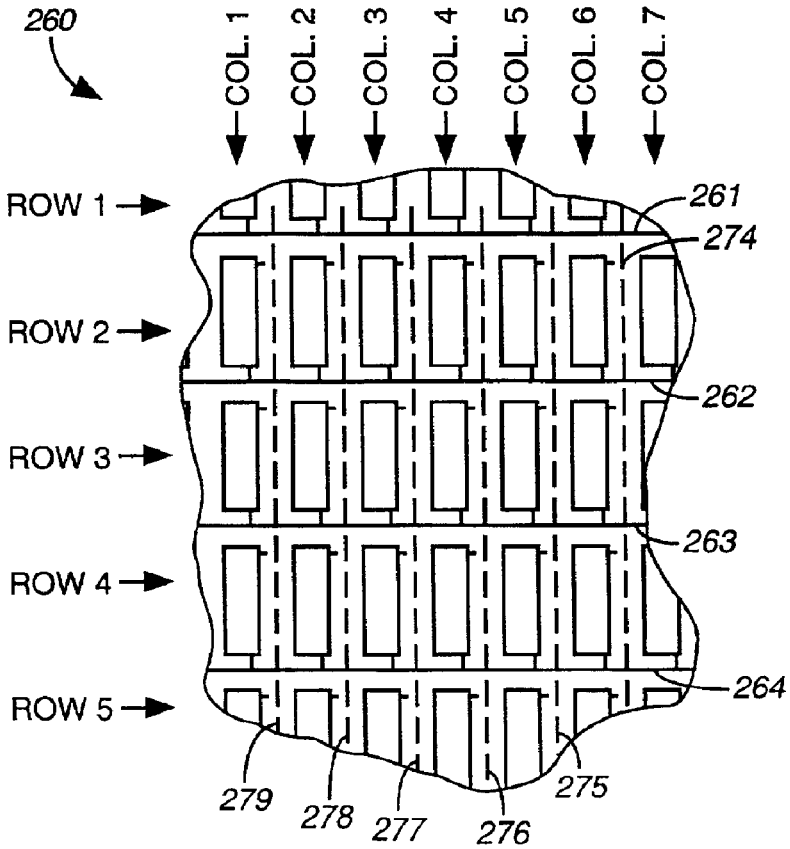

FIGS. 2A–2B illustrate two exemplary (enlarged) portions of an LCD, including segments representing individual pixels. (Note this is a representative illustration only, and is not intended to show the details of scale or resolution.) FIG. 2A is an exemplary LCD portion 210, which is a seven-pixel LCD in a standard configuration (with pixels enumerated 1–7). In some LCDs, such as the one depicted in FIG. 2A, it may be sufficient to directly supply the biasing voltage required to activate the liquid-crystal material associated with each pixel 1–7. That is, separate conductors 8–15 selectively supply a biasing voltage to the electrodes defining pixels 1–7, which are disposed on the opposite side of the liquid-crystal layer as is a back plate extending across the entire layer. The back plate (not shown) is continuously connected to active ground via conductor 16 so that a voltage applied to the electrode will always produce the voltage difference required to activate the liquid crystals. This configuration is sometimes referred to as a common-plane LCD and while simple and relatively efficient, it is also limited in the images it can reproduce. As mentioned above, the pixels are individually activated in order to created a light or dark area. Again, the term activated refers to the imposition of an electrical charge on the limited area of the pixel in order to alter the liquid crystal material that is proximately located. Typically an applied charge will result in light not being passed through the polarizing screens that surround the liquid crystal material, and hence pixel darkening, though this is not necessarily the case. For convenience, 'activation' will be used to describe the application of a voltage differential (very often one of alternating polarity) without regard to the specific effect created. In this context, it is also noted that different levels of pixel intensity may be created through varying the applied voltage. Again for convenience, the term 'activation' will refer to the application of any voltage level unless a distinction is specifically referred to in a particular context.

Note that the image-producing process is described in general terms for the purpose of illustration. The conventional process of driving an LCD to create a desired image is known in the art, and the present invention is intended to serve as an improvement thereon. In other words, it is applicable to produce a reduction in the power used to drive an LCD regardless of the specific method adopted for production of an unmodified image.

In more advanced LCD displays, another activation scheme may be used. For example in passive matrix displays pixels are arranged in rows and columns. An exemplary portion 260 of such a display is shown in FIG. 2B. Each pixel in a given column (the illustrated columns of LCD portion 260 are enumerated Col. 1 through Col. 6) is associated with a common ground conductor that can be selectively activated and deactivated. In other words, there is no continuous back plate (common-plane) serving as ground for all pixels. Correspondingly, electrodes positioned on the other side of the liquid crystal cell are connected to the same conductor by row (the illustrated rows of LCD portion 260 are enumerated Row 1 through Row 6). In FIG. 2B, for example, pixels in Row 1 through Row 4 are connected to conductors 261–264, respectively. (The conductor for Row 5 is not shown.) Pixels in Col. 1 through Col. 6 are connected to conductors 274–279, respectively. (The conductor for Row 7 not being shown.) In order to produce the proper image, selected columns (one or many) are connected temporarily to ground, and an appropriate bias voltage is at the same time applied to the conductors associated with a selected row or rows. Pixels at intersections of the selected rows and columns are thereby activated. This process may be used to activate one or any number of pixels, bearing in mind that all pixels located at an intersection of activated conductors will also be activated. Other configurations are possible (though not shown). For example, a single row may use two or more independent conductors. There should not be too many, however, or the conductors, which are not completely transparent, may begin to dominate the display. Note that grid-matrix LCDs such as the one represented by FIG. 2B may contain thousands of pixels, in contrast with the seven shown in FIG. 2A. The use of single conductors for a given row or column greatly reduces the number of conductors needed, though, at the same time, it somewhat complicates the driving process.

Row driver and column driver circuits are used to select the proper rows and columns, respectively, at the appropriate moment when a bias voltage is being applied. The row and column drivers, in turn, are directed by an appropriately programmed microprocessor. Using directed row and column drivers does not typically produce an entire image simultaneously, but rather in a series of steps; in each step a portion of the pixels making up the image are activated. Activated liquid crystal cells, however, take some time to return to an unactivated state, so as long as a rapid refresh rate is used (that is, pixels are activated again before completely relaxing to an unactivated state) the image appears continuously.

In an active matrix LCD (not shown), each pixel is associated with a thin film transistor (TFT). As the directed row and column drivers are selectively activated, TFTs at intersections allow an amount of charge through to an associated capacitor, which, in many cases, retains a charge sufficient to sustain pixel activation until the next refresh cycle.

Figure 3:
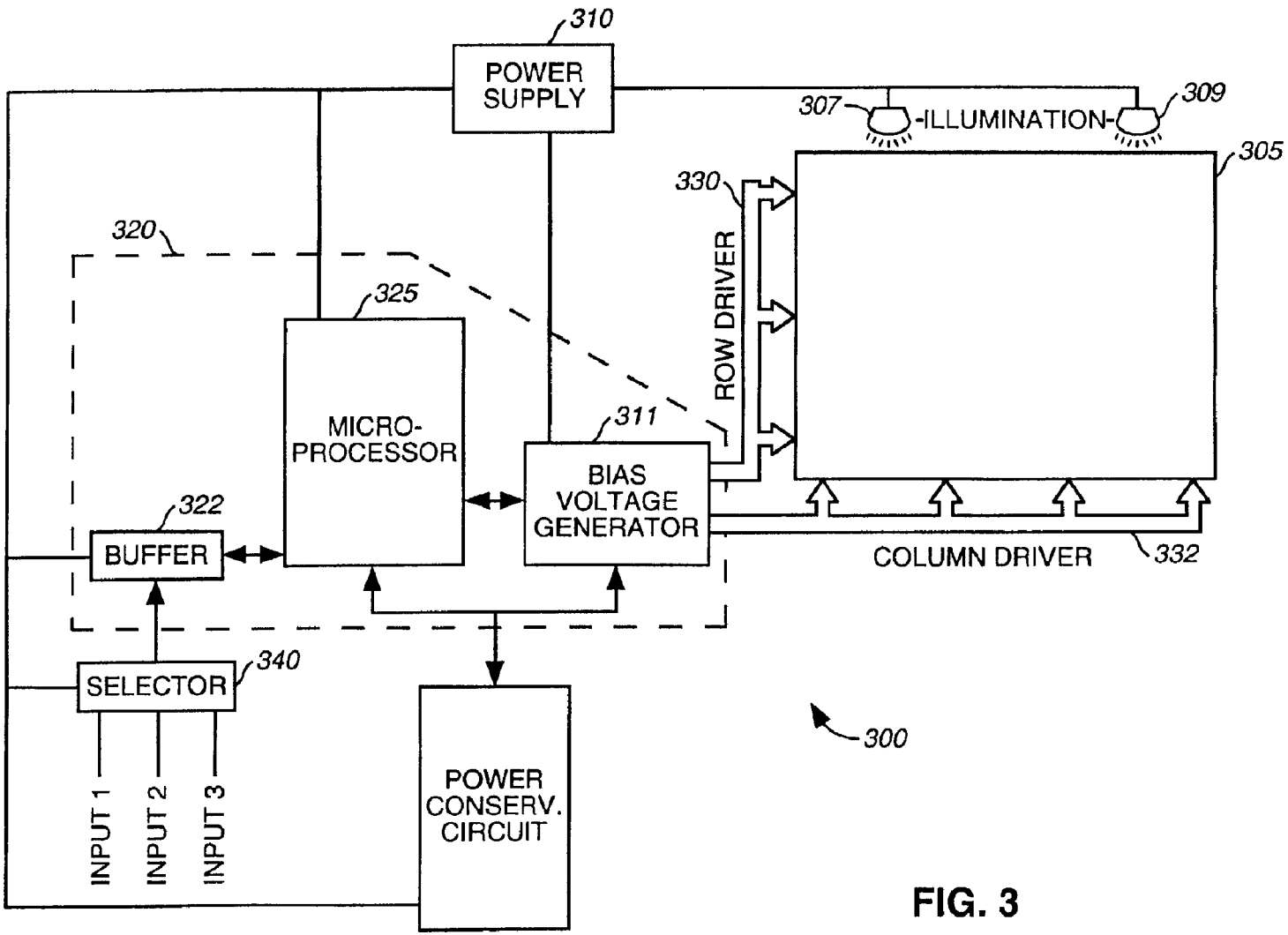
FIG. 3 is a schematic diagram of the LCD system of an electronic device according to an embodiment of the present invention.

FIG. 3 is a schematic diagram of an LCD system 300 according to an embodiment of the present invention. LCD 305 is illuminated by light sources 307 and 309, though it may also make use of ambient light, where available, in order to minimize power consumption. The power for light sources 307 and 309 comes from power supply 310, which also ultimately supplies power for pixel activation. Note that power supply 310 includes whatever circuitry is necessary to transform the power received from an ultimate source, such as an AC source or a battery, to the level required to power the various system components. (Although the system and method of the present invention is most advantageously employed with a limited-capacity source, such as a battery, it is applicable to devices that also or instead use other sources.) In the illustrated embodiment, LCD drive circuit 320 (delineated by broken line) includes an input buffer 322 for holding input image data until it is processed by microprocessor 325. Microprocessor 325 analyzes the image data and determines which pixels should be activated and in which sequence in order to produce a representation of the image contained in the input image data. Directions formulated by the microprocessor 325 are provided to bias voltage generator 311. The activation sequence also contains information on how great a voltage difference that should be applied to each pixel. LCD row driver 330 and column driver 332 transmit the activation sequence for application to LCD 305. (Individual pixels are not shown in FIG. 3.)

Input image data is received in LCD drive circuit 320 through selector 340. Selector 340 is used where image data may be received from a variety of sources. For example, in a camcorder (see FIG. 1A), image data may come directly from the charge-coupled device capturing and digitizing the image for storage, or it may be from the storage medium (videotape, for example) itself. In the case of a mobile phone or PDA device (see FIGS. 1B and 1C), the image data may be received from a device storage medium, but also may be received from the communications network through a wireless connection as well. Typically, the user will manually select the input source, but in some cases automatic operation may also be desired. For example, a camcorder set to "recording mode" may automatically select the image captured through lens 121 as the LCD input. In FIG. 3 the various image input sources that may be selected are generically labeled input 1, input 2, and input 3, respectively, although in practice there may be any number.

Note that the LCD system configuration of FIG. 3 is only one example of an LCD driver configuration, but in actual practice, the configuration may vary. For instance, the designation of the boundaries of LCD driver 320 is for illustration only. It could, for example, also be said to include the row and column drivers and power-conservation circuitry 335 as well. In practice, there may be a similar distinction based on the microprocessor used (and the circuitry included therein).

Figure 4:
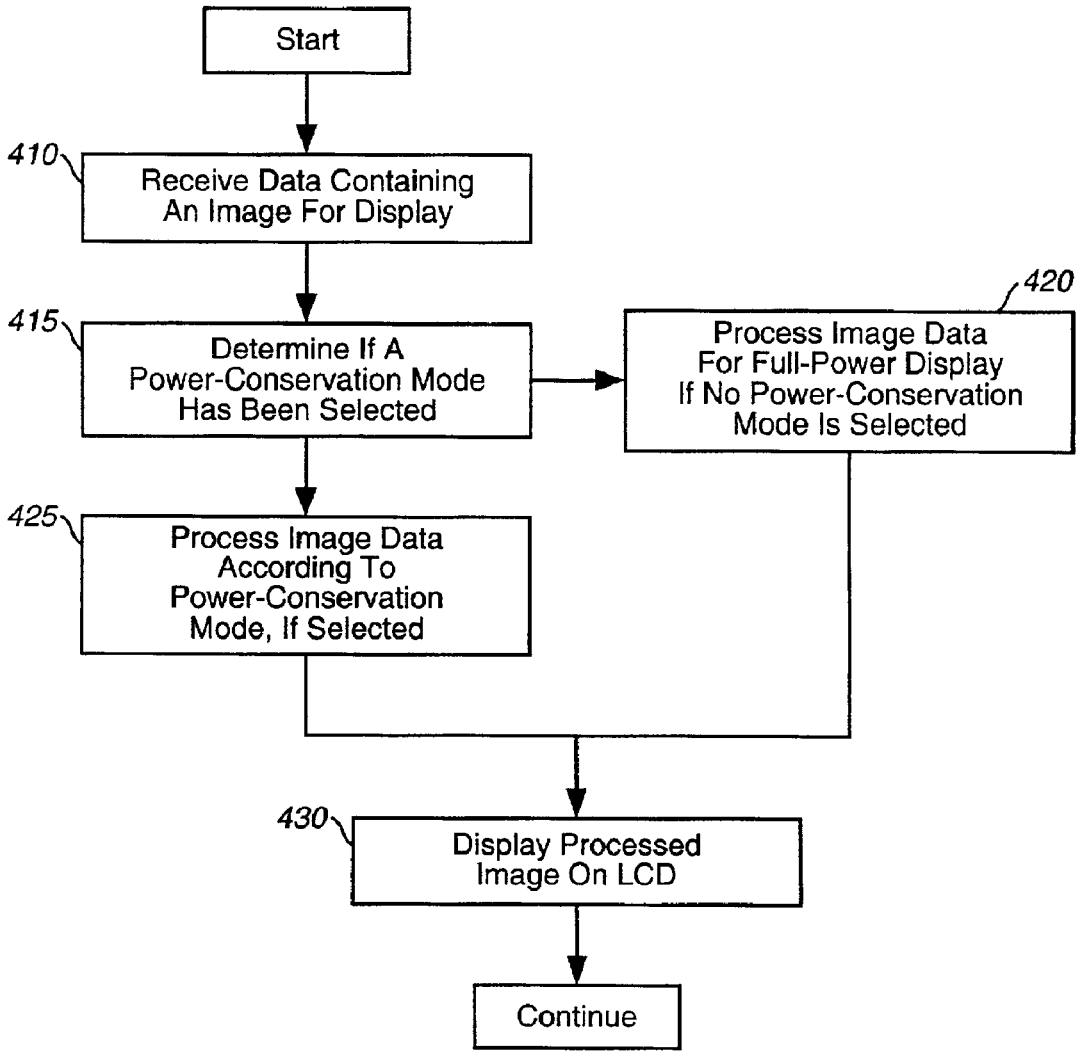
FIG. 4 is a flow diagram illustrating a process of conserving battery power according to an embodiment of the present invention.

FIG. 4 is a flow diagram illustrating a process of conserving battery power according to an embodiment of the present invention. The process 400 begins (START) with an LCD system such as the one illustrated in FIG. 3 functionally attached to a battery-powered electronics device. If necessary, the LCD is turned on (step not shown). When the LCD-driver begins to receive display-data input containing an image (step 410), it determines whether or not a power-conservation mode has been selected (step 415). If not, it proceeds to process the image data in its usual manner, (step 420). Referring, for example, to the embodiment of FIG. 3, this means that the image data processing function of microprocessor 325 and bias-voltage generator 311 remain unaltered. Returning to FIG. 4, when the driver determines that a power-conservation mode has been selected, however, the image processing procedure corresponding with the specified mode is applied (step 425). In either case, the processed data results in an image that is then displayed on the LCD (step 430). Selection of the alternate algorithm alters the pixel-activation sequence by selecting certain pixels that would otherwise be activated to miss activation for one or more image cycles. As implied in FIG. 3, this may be done in any of several ways. Where a properly configured microprocessor is used, the power-conservation circuit may simply detect a manual or automatic invocation of a particular power-conservation mode selection, and transmit a mode-change signal to the microprocessor accordingly. Using a standard microprocessor, the power-conservation circuit may instead intercept the signal delivered from the microprocessor to the bias-voltage generator and modify it according to the present invention. In yet another embodiment, the power-conservation circuitry is built into the bias voltage generator itself, which, in this embodiment, receives standard inputs from the microprocessor, but delivers modified pixel-energizing instructions to the row and column drivers.

Figure 5:
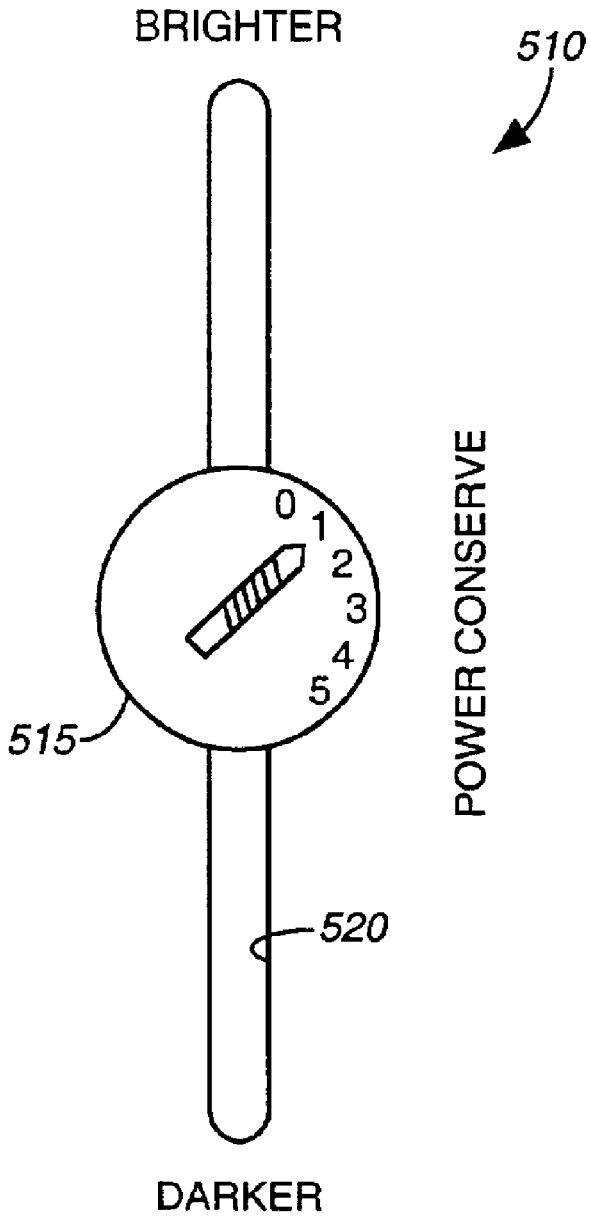
FIG. 5 is an illustration of an exemplary power-conservation mode selector switch as may be advantageously employed in accordance with an embodiment of the present invention.

As the alternate activation procedure will result in a modified visual display—one that is either brighter or darker than normal depending on the specific LCD. Although the user may well have themselves selected the power-conservation mode causing display alteration, they may also wish to temporarily return the image to its normal state when viewing a particular image. A selector switch, such as the example illustrated in FIG. 5, may be used to provide the electronic device with such a feature. Selector switch 510 includes a rotating power-conservation mode selector 515. The selector 515 may, for example, be rotable from setting 0, where no power-conservation mode is used, to setting 5, which may result in the most efficient operation, but also result in the poorest image. Or, the numerical settings may correspond to distinct masking patterns (in which case the numerals 1 to 5 represent distinct modes, rather than a scale from less image modification to more). Regardless of the selection, the user may also slide selector 515 along slot 520 toward either end, here marked "brighter" and "darker". As the labels imply, sliding the selector 515 in this manner induces the power conservation mode circuitry to adjust the PC-mode output by energizing more or fewer pixels to achieve the desired effect. Presumably, the user may then exercise a momentary image change or changes in a manner more convenient than repeatedly switching from one mode to another. In this case, the user can select brighter or darker, and when the LCD-driver receives such a request, it increases or decreases the number of pixel-activation cancellations accordingly. The processed image is then displayed on the LCD.

In any of these implementations, the power-conservation mode pattern or mask may take several forms or variation in degree. In one mode, the number of activated pixels is reduced by a certain percentage. In a fifty-percent reduction, every other active pixel may be skipped in the activation sequence. (This may be applied to LCDs with every pixel directly powered, or not as the case may be, and to multiplexed LCDs where it may be implemented as a lower than normal refresh rate, or as a normal refresh rate applied to only every other pixel.) A different pattern may also be implemented, for example by activating only one of every third or fourth pixels that would otherwise be activated in the border (outer) region of an image, while omitting the activation of only one in three in the central image region. Or a mode may be selected in which none of the border pixels are activated and the image is resized to fit in the now-smaller display region.

In one embodiment, the omitted pixels are alternated to reduce or even eliminate visible image degradation. This alteration may take the form of arbitrary alteration, for example in a mode having fifty percent of pixels omitted, in the next charge application the other fifty percent of pixels are omitted. The alteration pattern may also depend on the image itself with, for example, pixels in lighter (or darker) areas being omitted more often than those in darker (or lighter) areas.

Finally, note that the phrase, "power-conservation mode" refers herein to a device setting or configuration in which the image displayed on an LCD is to be formed using fewer energized (activated) pixels than would otherwise be utilized in non-power-conservation mode according to an embodiment of the present invention. Power-conservation mode may be entered and exited manually (in direct response to a user input commanding it to do so) or automatically. An automatic mode change is usually, but not necessarily responsive to the detection of a certain condition, such as low-battery power indication or, alternately, a network signal if the device is capable of network communication. In one embodiment, for example, a communications network signals the device to enter power-conservation mode when it receives a device transmission signal falling below a predetermined signal-strength threshold. In another embodiment, when the network-communications enabled device is manually set in a power-conservation mode, it automatically transmits a request with selected transmissions to return content that has already been modified to effect an image that uses less than full power for display, compared to an unaltered image. The above definition is for convenience and employed notwithstanding that other measures can also be taken to reduce power consumption, such as simply shutting the device off when not in use. In other words, as used herein, the phrase "power-conservation mode" refers only to the reduction of the device's power consumption through the reduction (and preferably elimination) of electrical power to selected LCD pixels according to a predetermined, and usually dynamic, matter. Further, "reduction" in power to individual pixels is simply reduced relative to the power level that would be used ("full power") absent implementation of the power-conservation scheme of the present invention—full power does not herein refer to the absolute maximum power that could be supplied or sustained by the device in question.

The preferred descriptions are of preferred examples for implementing the invention, and the scope of the invention should not necessarily be limited by this description. The scope of the present invention is defined by the following claims.

What is claimed is:

1. A method for conserving electrical power at an electrically-powered device having a liquid-crystal display (LCD) comprising a driver and a plurality of pixels, wherein the optical characteristics of the liquid crystal associated with each pixel are defined by the selective local application of an electrical charge, the electrically-powered device for communicating with a communications network, said method of conserving electrical power comprising the steps of:

receiving, in a driver of the LCD, data from the communications network, the data containing an image display on the LCD;

determining that a power-conservation mode, in which a selected number of the pixels are not energized, is appropriate according to predetermined criteria, the predetermined criteria comprising signals received from the communications network, the signals generated by the communications network upon detection of a device transmission signal transmitted by the electrically-powered device lower than a predetermined threshold;

analyzing the image data in a microprocessor of the LCD driver to determine the pixel-charging sequence required to produce the image associated with the data;

automatically entering power-conservation mode in which the selected number of the pixels are not energized by modifying the pixel-activation sequence to reduce the number of pixels to which voltage is to be supplied; and displaying on the LCD an image created by the modified pixel-activation sequence.

2. The method of claim 1, wherein the predetermined criteria for entering the power-conservation mode further comprises receipt of a user-entered instruction to enter power-conservation mode.

3. The method of claim 1, wherein the predetermined criteria for entering the power conservation mode further comprises a low-power indication generated within the device.

4. The method of claim 1, wherein the predetermined criteria for entering a power conservation mode further comprises a reduce-power signal.

5. The method of claim 1, further comprising the steps of:

determining that leaving the power-conservation mode is appropriate according to predetermined criteria; and leaving the power-conservation mode by returning to full power for all pixels.

6. The method of claim 1, further comprising the step of selectively alternating the subset of no-power pixels.

7. A method of claim 1, wherein the predetermined criteria for entering power-conservation mode includes an indication of the level of ambient light.

8. A for method of claim 1, wherein the predetermined criteria for entering power conservation mode includes an automatically-generated timing signal.

9. The method of claim 1, wherein the subset of no-power pixels is selected according to the image being displayed.

10. A portable electronic device for communicating with a communication network comprising:

a receiver for receiving information from the communications network;

a liquid-crystal display (LCD) comprising a plurality of pixels for displaying images according to the information received from the communications network; and an LCD driver for receiving the received information and translating at least a portion of the information into instructions for selectively activating the pixels in order to produce an image, wherein the LCD driver determines if a power-conservation mode in which a selected number of pixels are not energized has been automatically selected, the power-conservation mode determined to be automatically selected if signals generated by the communications network upon detection of a device transmission signal transmitted by the portable electronic device is lower than a predetermined threshold, and, if so, modifies the instructions accordingly.

11. The device of claim 10, wherein the automatic selection of power-conservation mode is further responsive to a low-battery indication.

12. The device of claim 10, wherein the instruction modification performed if power-conservation mode has been selected includes omitting a predetermined number of pixel-activations.

13. The device of claim 12, wherein the number of omitted pixel-activations is determined as a first selected percentage of the total number of pixels to be charged during a first defined portion of the pixel-activation sequence.

14. The device of claim 13, wherein approximately fifty percent of the pixel-activation are omitted.

15. The device of claim 13, wherein a second selected percentage of the total number of pixels to be activated determines the omitted pixel-activations in a second defined portion of the pixel-activation sequence.

* * * * *